United States Patent [19]

Stavenau

[11] 4,246,981

[45] Jan. 27, 1981

[54] PORTABLE OBSERVATION STAND

[75] Inventor: Harold L. Stavenau, Owatonna, Minn.

[73] Assignee: Truth Incorporated, Owatonna, Minn.

[21] Appl. No.: 67,532

[22] Filed: Aug. 17, 1979

[51] Int. Cl.[3] ..... E06C 1/08; E06C 1/393

[52] U.S. Cl. ..... 182/116; 182/129; 182/156

[58] Field of Search ..... 182/116, 120, 121, 122, 182/123, 129, 24, 117, 156

[56] References Cited

U.S. PATENT DOCUMENTS

| | | | |
|---|---|---|---|
| 2,723,674 | 11/1955 | Harris | 182/116 |
| 3,057,431 | 10/1962 | George | 182/116 |
| 3,143,185 | 8/1964 | Wenger | 182/24 |
| 3,848,699 | 11/1974 | Goodwin | 182/24 |
| 4,134,474 | 1/1979 | Stavenau | 182/116 |

*Primary Examiner*—Reinaldo P. Machado

*Attorney, Agent, or Firm*—Wegner, Stellman, McCord, Wood & Dalton

[57] ABSTRACT

A portable observation stand having a ladder formed of upper and lower ladder sections pivotally interconnected at adjacent ends for movement between a folded position and an extended position in end-to-end relation, a seat and a foot-support member are both pivotally connected to the upper ladder section with the seat arranged to be in operative position above and rearwardly of the foot-support member. The seat is disposed rearwardly of the rails of the upper ladder section and the foot-support member has a pivotable part thereof movable to an overlapped position with the remainder thereof whereby a person can climb the ladder to the seat level without obstruction thereby. Linkage structure interconnects the seat and foot-support member for simultaneous movement thereof between an operative position extending at a substantial angle to the upper ladder section and a storage position substantially parallel with the upper ladder section to facilitate folding of the stand.

7 Claims, 7 Drawing Figures

80
81
80a
4.
90
82
17
11
105
100
18
110
42
25
111
41
T
30
31
4.
20
30
15
16
10

84
90
83
86
60
80
63
82
70
10
46
40
16
11
20
46a
71
65
18
20
41
51a
33
33
31
30
34
32
35

90
86
11
82
60
62
61
80
115
70
63
18
72
40
42
64
46
66
71
46a
65
67
41
51
51a
73
31
34
36
32
30
10
35
16

90
17
91
18
81
87
92
100
82
45
46
70
42
70
48
50
52
51
71
105
49
71
20
15
20
16

80
81
85
87
5.
5.
61'
115
60'
62'
6.
6.
100
70'
72'
17
63'
25
42
40
45a
45
66'
64'
71'
65'
49
52
41
48
73'
50a
50
67'
31
34
30
32
15

102
63'
60'
101
70'
100

PORTABLE OBSERVATION STAND

BACKGROUND OF THE INVENTION

This invention pertains to a portable observation stand which may easily be moved between a folded position and an extended, operative position and which enables easy access to an observer's station on the stand with confortable support of an observer.

During wild life observation or hunting, it is often desirable to be located above the ground. A variety of portable observation stands for association with a tree or pole have been developed which permit the observer to transport the stand to the desired location and then associate the stand with a tree. Such stands commonly include a ladder enabling climbing up to the observer's location on the stand. An example of such a stand is shown in U.S. Pat. No. 4,134,474 wherein the applicant herein is one of the patentees. As shown in said prior patent, the observation stand has a set and a foot-support member with a ladder enabling climbing to the observer's location and the framework includes structure for supporting a weather-protective shroud around the seat area of the stand. The structure of the prior patent requires attaching structure for attaching the stand to the tree and requires foldup of certain ladder sections into a position to form a foot-support member.

The structures of the aforesaid prior patent as well as others shown in the prior art are difficult to use in requiring the secure attachment to the tree and positioning of the various components to form the seat and foot-support member for use by the observer and also render it difficult to enter and leave the observer's station.

SUMMARY OF THE INVENTION

In accordance with the present invention, a portable observation stand includes a ladder formed of upper and lower ladder sections which can be carried to the desired location in a folded position and then extended in an end-to-end relation and placed against a tree or pole at an angle with a member at the upper end thereof shaped to engage a tree and to accommodate widely varying tree diameters with the structure being self-sustaining without attachment to the tree. A foot-support member and seat are pivotally connected to the upper ladder section positions for comfortable support for an observer and have an operative position wherein they do not obstruct the climbing of the ladder by an observer and entry into the observer's station. The seat and foot-support member are simultaneously movable by linkage structure between an operative position and a position which facilitates bringing the ladder sections into an overlapped, folded position for transport.

A feature of the invention is to provide a portable observation stand which can be easily erected at the site, with simultaneous movement of a seat and a foot-support member to an operative position and with location of said last-mentioned members in positions to be in non-obstructing relation with an observer as he climbs the ladder to the observer's station.

Still another feature of the invention is to provide a portable observation stand formed of upper and lower ladder sections having a width sufficient to provide firm ground-engaging support and with the upper end of the upper ladder section having a member shaped to engage a tree and firmly guide and hold in position the upper end of the ladder.

Other features of the invention relate to the use of linkage structure providing for simultaneous movement of said seat and foot-support member and also providing a mounting for a weather-protective shroud surrounding the observer's station, hinge means interconnecting the ladder sections including hinge plates shaped to provide a foot to enable erect positioning of the portable observation stand when folded, as well as other features of construction which enable simple erection of the stand at the site as well as ease of entry into the observer's station and provide for comfort of the observer including a canopy unit movable into position above the observer's station.

DESCRIPTION OF THE PREFERRED EMBODIMENT

Figure 1:
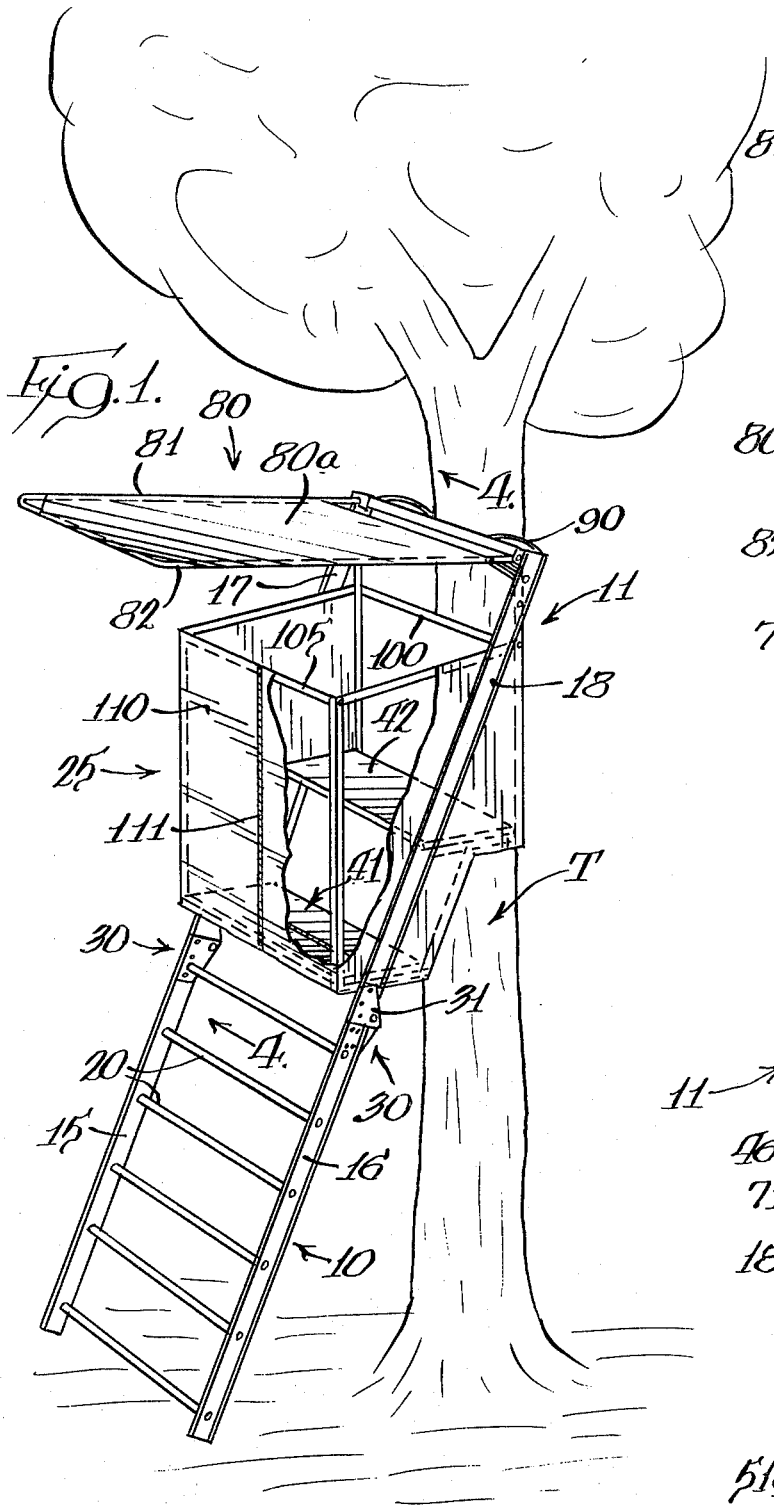
FIG. 1 is a perspective view of the portable observation stand shown in association with a tree and with parts broken away.

Referring first to FIG. 1, the portable observation stand is shown in association with a tree, identified at T, with the stand comprising a ladder formed of a lower ladder section, indicated generally at 10, and an upper ladder section, indicated generally at 11. Each of the ladder sections 10 and 11 has side rails, with there being side rails 15 and 16 for the lower ladder section and side rails 17 and 18 for the upper ladder section. The lower ladder section has a series of rungs 20 extended between the side rails enabling an observer to climb up the ladder to an observer's station, indicated generally at 25, and which has structure supported by the upper ladder section 11.

Figure 2:
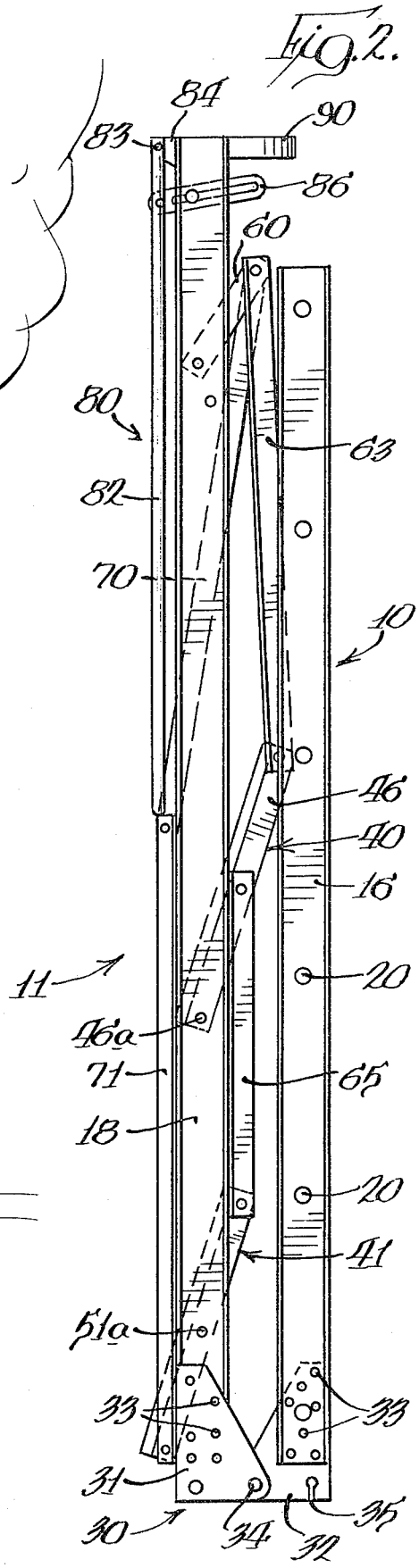
FIG. 2 is a side elevational view of the portable observation stand shown in folded position and positioned upright on a foot-support.

The ladder sections 10 and 11 are movable between a folded position in overlapped relation, as shown in FIG. 2, and the erected position, shown in FIG. 1, by means of hinge means, indicated generally at 30. The hinge means comprises a pair of hinge plates 31 and 32 associated with each pair of adjacent side rails and secured thereto by a plurality of rivets 33. Each pair of hinge plates is interconnected by a hinge pin 34 which is positioned at the rear of the side rails when the stand is erected and at an angle to the tree whereby the weight of an observer creates a force tending to firmly hold the ladder sections in erected operative position because of a slot 35 in the hinge plate 32 having been rotatably moved into position with a pin 36 carried on the hinge plate 31. The slot 35 has a keyhole shape whereby the pin 36 can include a threaded, cone-shaped locking surface movable into the enlarged area of the keyhole slot 35.

The observer's station 25 includes a seat, indicated generally at 40, and a foot-support member, indicated generally at 41. The seat 40 has a planar member 42 which extends for the width of the observer's station and has its opposite ends supported by a pair of structural members 45 and 46, each of which is pivoted adjacent their front end at 45*a* and 46*a* to the side rails 17 and 18, respectively, of the upper ladder section.

The foot-support member 41 is made up of a pair of planar members 48 and 49 which extend for the width of the observer's station, with the planar member 48 being supported by a pair of angle members 50 and 51, respectively, which are each pivotally connected intermediate their ends at 50*a* and 51*a* to the side rails 17 and 18 of the upper ladder section, respectively. The other planar member 49 is hingedly connected along its length by hinge means 52 to the planar member 48 whereby the planar member 49 may have the operative position shown in FIG. 1 and in full line in FIG. 4 and be movable to a retracted position, shown in broken line in FIG. 4, to facilitate entry of an observer into the observer's station.

Figure 3:
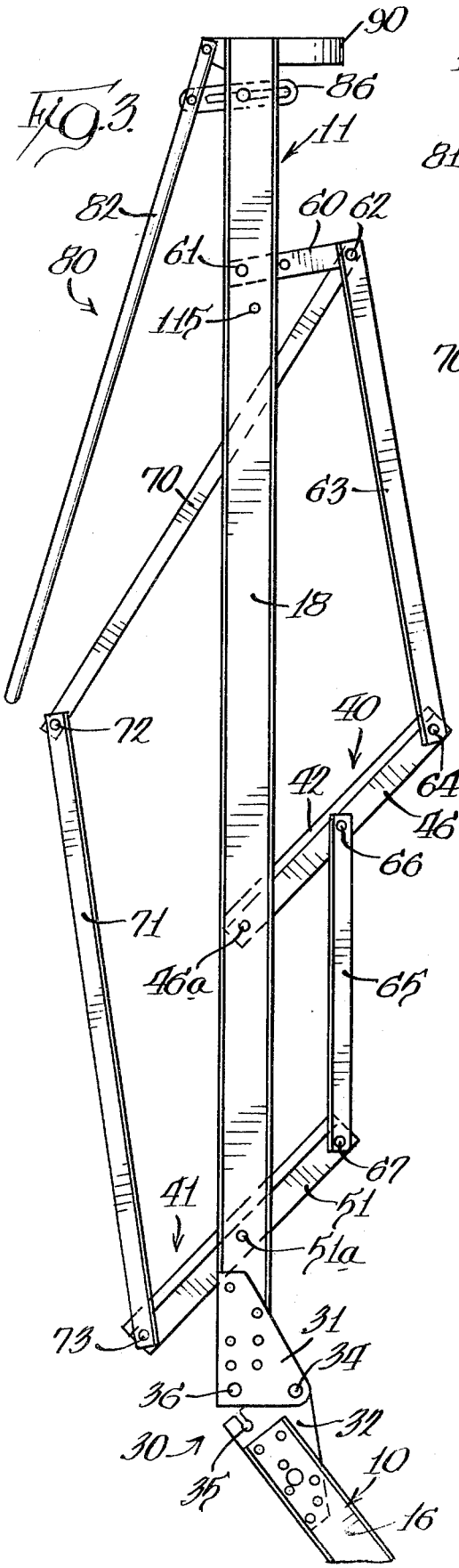
FIG. 3 is a fragmentary view of the portable observation stand as laid on the ground for erection and showing the structure in a position between the folded storage position and the extended position.
Figure 5:
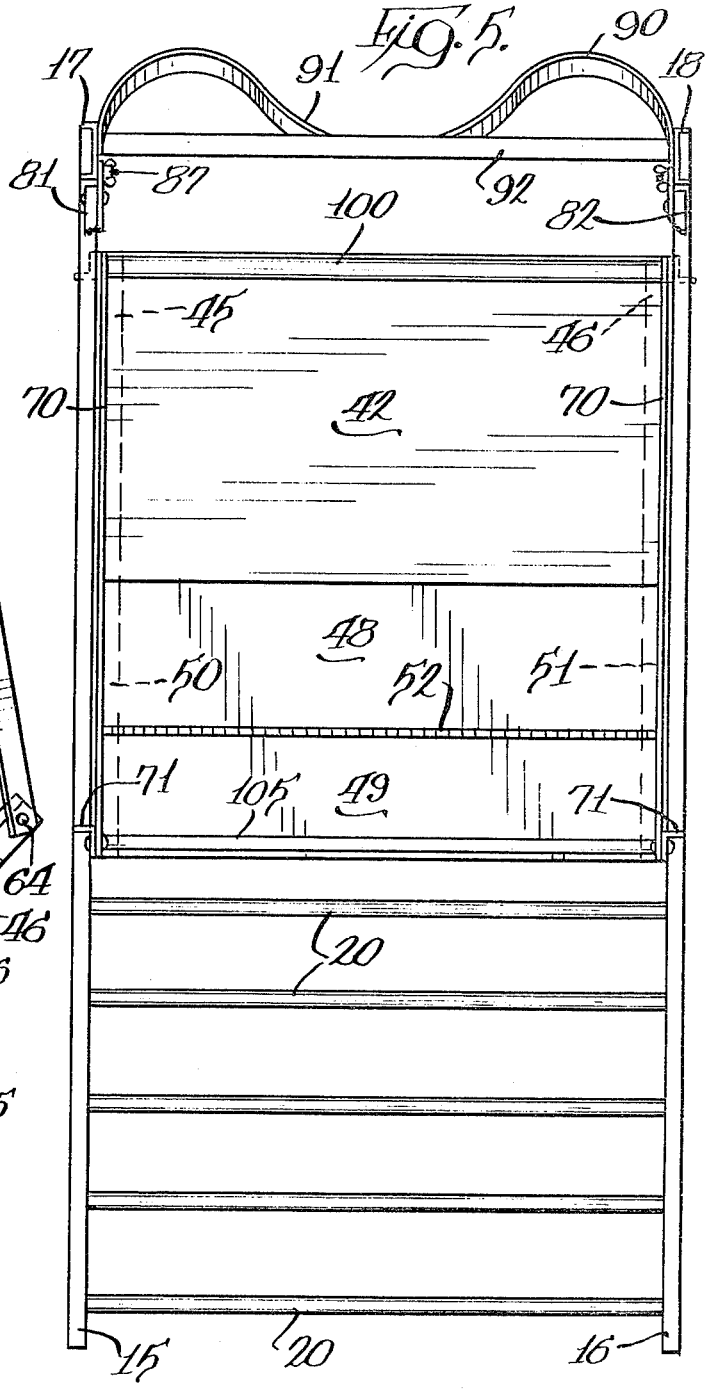
FIG. 5 is a plan section, taken generally along the line 5—5 in FIG. 4.
Figures 4, 6:
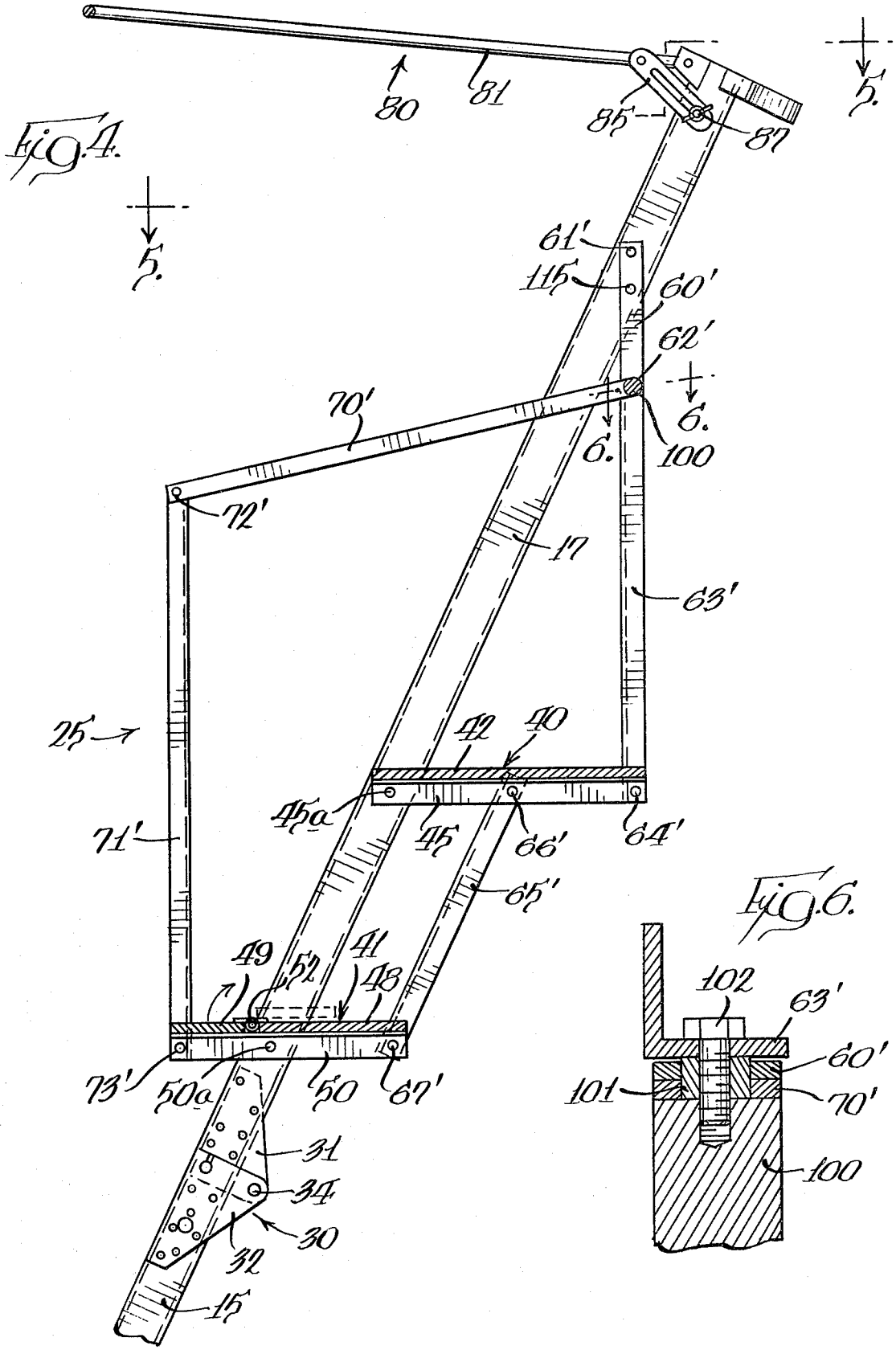
FIG. 4 is a fragmentary side elevational view of the portable observation stand shown in operative position, but without the support thereof against a tree.
FIG. 6 is a fragmentary sectional view, on an enlarged scale and taken generally along the line 6—6 in FIG. 4.

The seat 40 and foot-support member 41 are movable between a storage position shown in FIG. 2 and the operative position, shown in FIGS. 1 and 4, with simultaneous movement thereof between said positions by linkage structure. The linkage structure is duplicated at each side rail of the upper ladder section, with the linkage structure at one side rail being shown in FIG. 3 and including the relatively short link 60 pivotally connected to the side rail 18 at 61 and pivotally connected at 62 to a connecting link 63 which extends to a pivot connection at 64 to the rear of the seat 40. An interconnecting link 65 extends between the seat 40 by a pivotal connection 66 intermediate the front and rear thereof to a pivot connection 67 with the rear of the foot-support member 41. Additional links include a link 70 extended from the pivot connection of short link 60 to connecting link 63 and a link 71 pivotally connected to an end of the link 70 at 72 and extending to the front edge of the foot-support member for pivot connection thereto, as indicated at 73. The corresponding links and pivot connections associated with the side rail 17 have been given the same reference numeral as the similar structure associated with the side rail 18 and with a prime affixed thereto.

A canopy unit, indicated generally at 80, has a generally U-shaped frame with a pair of legs 81 and 82 which are each pivotally connected as by a pivot pin 83 for the leg 82 to a bracket 84 carried at the upper ends of the side rails 17 and 18. A cover 80*a* of fabric or other material is mounted on the frame. The canopy unit is moved between a storage position, shown in FIG. 2, and an operative position, shown in FIG. 4, by pivoting thereof on the mounting brackets and with the canopy unit being held in position over an observer at the observer's station by a pair of slotted plates 85 and 86 which coact with a threadable member 87 associated, one with each of the slidable plates, and threaded into the associated side rail whereby it may be tightened to hold the slotted plates and canopy unit in the desired position.

The upper ladder section 11 has tree-engaging means at the upper end thereof including a rigid member 90 extending between the side rails 17 and 18 and having a concave intermediate section 91 shaped to fit against a tree and accommodate trees of varying diameter whereby the upper end of the ladder is securely located and provides a firm support for the stand in association with the broad span of contact with the ground provided by the side rails 15 and 16 of the lower ladder section. The member 90 has increased strength by having the intermediate section thereof secured to a brace member 92 extending between the side rails 17 and 18.

A feature providing added strength to the linkage structure associated with the seat and foot-support member is shown in FIG. 6 wherein the connecting link 63' is locked to a solid rod 100 extending to the similar connecting link 63 and with the short link 60' and the link 70' being free to rotate about a spacer 101 captured by a machine screw 102 which holds the link 63' to the connecting rod 100 and which maintains a space whereby the links 60' and 70' are free to rotate. The mounting of the links 60, 63 and 70 at the opposite end of the connecting rod 100 is the same as that shown in FIG. 6.

As shown particularly in FIG. 1, a connecting member 105 extends between the upper ends of the links 71 and 71' and in generally parallel relation with the connecting rod 100 to provide with the links 70 and 70' a support for a weather-protective shroud 110 which surrounds the observer's station and is held in position by the linkage structure and which has a zipper 111 to permit opening of front flaps for easy access into the observer's station.

The portable observation stand is shown in folded condition in FIG. 2 for transport to the site and as shown can be self-maintaining in an upright position by straight edges of the hinge plates 31 and 32 for each side rail forming an elongate foot. The stand is most easily erected by laying the unit on its side and pivoting the ladder sections relative to each other to bring them from an overlapped position, shown in FIG. 2, to an extended position wherein the ladder sections are in end-to-end relation and as shown in FIGS. 1 and 4. During this movement, the hinge plates are brought into firmly locked relation by the pin and slot arrangement previously described. The next step is to move the seat and foot-support member from a storage position wherein they extend substantially parallel to the upper ladder section, as shown in FIG. 2, to the operative position, shown in FIGS. 1 and 4, and with an intermediate position thereof being shown in FIG. 3. This is accomplished by pulling on a component of the linkage structure and which brings the linkage to the position shown in FIG. 4 wherein the short links 60 and 60' are in straight-line relation with the connecting links 63 and 63' whereby the weight of an observer on the seat 40 acts directly on the straight-line relation and the weight results in a pull on the linkage. The seat can be maintained in operative position by a retractable latch pin 115 on the side rail 17 engaging within an opening in the short link when the short link is in the position shown in FIG. 4. The stand is then erected in position against a tree with the tree-engaging means 90 in engagement with the tree and the ladder at an angle whereby the firm support provided by the wide spacing of the side rails 15 and 16, together with the tree-engaging means 90 provides a firm support for the observation stand.

The shroud is then opened to permit access to the observation station by operation of the zipper 111 and the foot-support panel member 49 is folded back to the position shown in broken line in FIG. 4. An observer then climbs the ladder and easily enters the observer's station because of the nonobstructing relation of the foot-support member and also because of the location of the seat 40 rearwardly of the ladder side rails. Also, this enables the observer to more easily move beneath the connecting member 105.

Once at the observer's station, the foot-support member 49 can be moved to its normal position and the shroud closed, whereby the observer is comfortably positioned on the seat 40 with his feet supported on the foot-support member 41 and with the shroud closed to assist in comfort. The canopy unit 80 will have been positioned in its uppermost position to facilitate upright movement of the observer into the observer's station and after being seated therein the observer may adjust the canopy unit to any desired angle within the limit of adjustment.

I claim:

1. A portable observation stand comprising, a ladder formed of upper and lower ladder sections pivotally interconnected at adjacent ends for movement between a folded position and an extended position in end-to-end relation, a seat pivotally mounted on the upper ladder section and movable between a storage position and an operative position wherein said seat extends rearwardly only from said upper ladder section to be in unobstructing relation with the ladder section for climbing thereof, a foot-support member pivotally mounted to said upper ladder section, and means interconnecting said seat and foot-support member for simultaneous pivoting movement.

2. A portable observation stand as defined in claim 1 wherein said interconnecting means comprises a linkage structure with pivotally interconnected links and certain of said links provide a frame for support of a weather protection shroud.

3. A portable observation stand comprising, a ladder having upper and lower ladder sections with side rails and a series of rungs on at least said lower section, means interconnecting said ladder sections for movement between a folded position in overlapped relation and an operative position with the ladder sections in end-to-end relation, a planar foot member pivotally connected to the side rails of the upper ladder section, a seat pivotally connected to the side rails of the upper ladder section, said foot member and seat having their pivotal connections related whereby said seat is disposed rearwardly of and above said foot member when the ladder is in operative position with major parts of each being to the rear of said side rails to permit a person climbing the ladder to easily reach said seat, and a plural link structure interconnecting the seat and the foot member for simultaneous movement between a position substantially paralleling said side rails and an operative position at a substantial angle thereto with two pairs of said links being pivotally interconnected and pivotally connected one pair to each side rail and a seat edge and in a straight-line relation when said seat is in operative position to support the weight of an occupant of the seat and hold the seat and foot member in operative position.

4. A portable observation stand as defined in claim 3 including latch means to hold said pairs of links in said straight-line relation.

5. A portable observation stand as defined in claim 3 wherein said foot member has a part extended forwardly of said side rails of the upper ladder section when in operative position, and said part being hinged to the remainder thereof for movement to a position overlapping said remainder to avoid obstruction of a person climbing the ladder.

6. A portable observation stand as defined in claim 5 wherein said seat is pivotally connected to said side rails at the front of said seat whereby the entire seat is located to the rear of the side rails when in operative position.

7. A portable observation stand comprising, a ladder having upper and lower ladder sections with side rails and a series of rungs on at least said lower section, means interconnecting said ladder sections for movement between a folded position in overlapped relation and an operative position with the ladder sections in end-to-end relation, a planar foot member pivotally connected to the side rails of the upper ladder section, a seat pivotally connected to the side rails of the upper ladder section, said foot member and seat having their pivotal connections related whereby said seat is disposed rearwardly of and above said foot member when the ladder is in operative position with major parts of each being to the rear of said side rails to permit a person climbing the ladder to easily reach said seat, and a plural link structure interconnecting the seat and the foot member for simultaneous movement between a position substantially paralleling said side rails and an operative position at a substantial angle thereto.

* * * * *